United States Patent [19]

Armstrong et al.

[11] 4,013,041

[45] Mar. 22, 1977

[54] SELF-COMPENSATING PHOTOCONDUCTOR WEB

[75] Inventors: Timothy G. Armstrong, Rochester; Arthur S. Kroll, Spencerport; Frank A. Shuster, Rochester, all of N.Y.

[73] Assignee: Eastman Kodak Company, Rochester, N.Y.

[22] Filed: Oct. 24, 1975

[21] Appl. No.: 625,427

[52] U.S. Cl. ..... 118/656

[51] Int. Cl.[2] ..... G03G 15/08

[58] Field of Search ..... 118/637, DIG. 23; 222/57, DIG. 1; 427/21; 355/3 D

[56] References Cited

UNITED STATES PATENTS

| | | | |
|---|---|---|---|
| 3,543,720 | 12/1970 | Drexler | 118/637 |
| 3,674,353 | 7/1972 | Trachtenberg | 355/3 D |
| 3,876,106 | 4/1975 | Powell et al. | 222/57 |
| 3,893,416 | 7/1975 | Eichorn | 118/637 |

*Primary Examiner*—Henry S. Jaudon
*Attorney, Agent, or Firm*—John D. Husser

[57] ABSTRACT

An electrographic apparatus, of the type employing a brush-type developer applicator which contacts one side of a flexible electrostatic image-bearing web, has (1) a web feed-path constructed in a predetermined configuration and (2) the applicator predeterminedly positioned relative to the feed-path defining elements, such that the flexible image-bearing web is allowed to move freely toward and away from the developer applicator in response to the varying contours of the applicator.

8 Claims, 3 Drawing Figures

FIG. 2
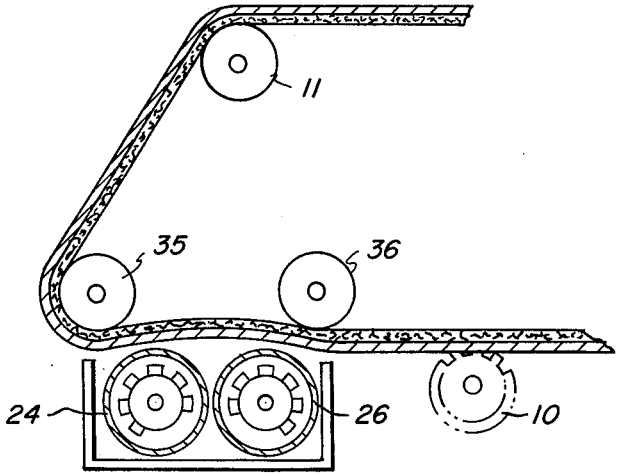
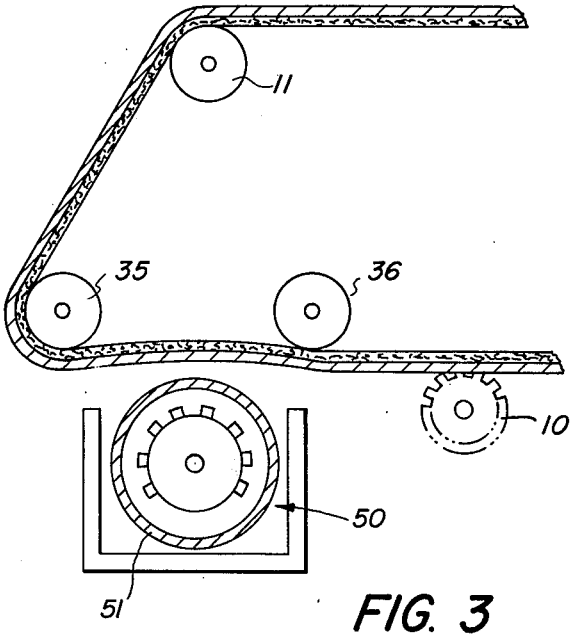
FIG. 3

SELF-COMPENSATING PHOTOCONDUCTOR WEB

FIELD OF THE INVENTION

The invention relates generally to electrographic apparatus and more specifically to an improved structural arrangement in electrographic apparatus of the type having a flexible electrostatic image-bearing web, which arrangement achieves improved image development with low background density by reducing variance in the spacing between the developer applicator and the image-bearing surface of the web.

DESCRIPTION OF THE PRIOR ART

Various triboelectric developing systems including cascade, fur brush, magnetic brush and combinations of those systems have been utilized in electrographic apparatus for the development of electrostatic images. However, there has existed a continuing problem in such apparatus in achieving uniform development of the various types of latent electrostatic images. By "uniform development" is meant the substantially complete development of fine line image areas as well as image areas with larger detail and solid areas, all with minimum background density.

Magnetic and fur brush systems having a bias potential between background and image area potential have been utilized with good success. In magnetic brush systems, finely divided toner particles are attracted to the surface of much larger, magnetically attractable carrier particles by electrostatic charges (created by triboelectrification between the toner and carrier) and applied to the image via a bristle-like mixture of carrier and toner magnetically attracted to a rotating magnetic drum. When the developer (i.e., toner and carrier) is brought into contact with an electrostatic image-bearing web, the attraction of the image for the triboelectrically charged toner overcomes the attraction of the carrier for the toner and the image is developed. In fur brush systems toner particles are similarly triboelectrically attracted to rotating fibers applied to the image areas of the web. In both systems, electrical bias can be applied to the applicator to supplement attractive (or repelling) electrostatic forces and improve development of solid areas and minimize background development.

However, uniformity problems occur in magnetic and fur brush developing systems when variations occur at the interface between the toner to be applied and the image to be developed. As an extreme example, when the applicator (and hence the toner) is too far from the photoconductor web, the toner will not be sufficiently attracted by the electostatic images to transfer from the applicator.

At the other extreme, when the image surface is too close to the applicator, the applicator will smear the transferred toner image. Also in such instances in magnetic brush devices, carrier particles will be "picked up" by the photoconductor. Too intimate a contact between the photoconductor and applicator also risks damage to the photoconductor by scratches from the applicator. Between these extremes, more subtle problems are caused by variation in the space between the applicator and photoconductor, e.g., due to variation in the bias field operative between those elements.

Since the fur brush and magnetic brush systems are dynamic systems, substantial variation can occur in the amount of developer present between the photoconductor surface and the developer applicator. This is primarily due to the manner in which the developer is brought into contact with the image on the photoconductor surface. For example, in the magnetic brush systems, the carrier particles, which are ferromagnetic in nature, are held to an applicator surface, for example, a non-magnetic cylinder, in bristle formation by magnetic attraction, and in normal operation variations occur in the quantity of carrier attracted. The quantity of toner attracted to the carrier in such systems varies with toner concentration of the developer mixture. Also the carrier particles of fur brush bristles may attract varying amounts of toner depending on humidity conditions.

Since most of the prior art developing apparatus maintained the photoconductor web in a more of less fixed path of travel across the development station, variations in the amount of developer present between the photoconductor and the developer applicator result in the previously discussed problems.

Some prior art apparatus, e.g., see U.S. Pat. No. 3,543,720, utilize a flexible photoconductor web and therefore, have some inherent variation in the position of the photoconductor web relative to the vertical position of the applicator and developer. Such slight movement of the photoconductor, above or below its normal path of travel, may compensate to some degree for variations in the amounts of developer present between the photoconductor and the developer applicator but it is not sufficient to avoid the aforementioned problems. That is, if the amount of such movement of the photoconductor at the development station is not sufficient and controlled, the movement of the photoconductor will not be useful to alleviate the aforementioned uniformity problems.

SUMMARY OF THE INVENTION

In view of the problems outlined above, there is a need in electrographic apparatus to compensate for variations in uniformity of development caused by continuous fluctuations in the quantity of developer at the photoconductor-applicator interface.

It is therefore an object of the present invention to provide an improved developing apparatus which will compensate for such variations and achieve more uniform development by providing a more consistent developer-photoconductor interface.

The above-mentioned object as well as other objects and advantages are accomplished in accordance with the present invention by provision in electrographic apparatus utilizing a flexible image member, of: (1) belt transport means which disposes the photoconductor in a non-tensioned condition during its generally horizontal movement over the development zone (2) a developer applicator located in a predetermined position relative to the continuous path of travel of the photoconductor and (3) means to control movement of the photoconductor in a direction generally normal to its continuous path of travel during its movement past the development station.

With this structural arrangement, the photoconductor can move toward and away from the applicator in response to the aforedescribed variations in developer at the applicator-photoconductor interface.

It will be further appreciated from the following detailed description that the invention disclosed herein provides an efficient and practical apparatus for improving the development uniformity of electrostatic image areas while also reducing background density and carrier pick-up.

BRIEF DESCRIPTION OF THE DRAWINGS

The objects, advantages and characteristic features of the subject invention will be in part apparent from the accompanying drawings, and in part pointed out in the following detailed description of the invention in which reference will be made to the accompanying drawings wherein like reference numerals designate corresponding parts, and wherein:

FIG. 2 is an enlarged view of a portion of the electrographic apparatus shown in FIG. 1; and FIG. 3 is a partial schematic view of a single magnetic brush development device incorporated in an electrographic apparatus in accordance with another embodiment of the invention.

Referring now to FIG. 1, an electrophotographic apparatus incorporating one embodiment of the present invention is schematically illustrated. The operative stations of the apparatus are of conventional type and include a primary charging station 1 at which a uniform electrostatic charge is placed on image segments of endless photoconductive belt 2 of the type comprising a photoconductive insulative layer 4 overlying a conductive backing layer 3. To insure that the image segments on belt 2 are uniformly charged belt 2 is maintained in a relatively rigid position by rollers 11 as it passes over charging station 1. After receiving the primary charge, an image segment passes under an exposure station 5 whereat a light image of a document to be copied imagewise discharges the segment, which then is developed at development station 20. As belt 2 passes over exposure station 5 it is maintained in a flat position by plate 16. Subsequently the developed segment moves past transfer station 6 where paper, fed from supply 7, is temporarily tacked to belt 2 by a corona charger as it receives the developed toner image. After leaving station 6 the paper is separated from belt 2 and the residual toner is then removed from the image segment at cleaning station 8 and the segment is passed under erase illumination at station 9, where belt 2 may be maintained in either a tension or non-tension position, to relieve residual charges thereon prior to initiation of another copy cycle.

Figure 1:
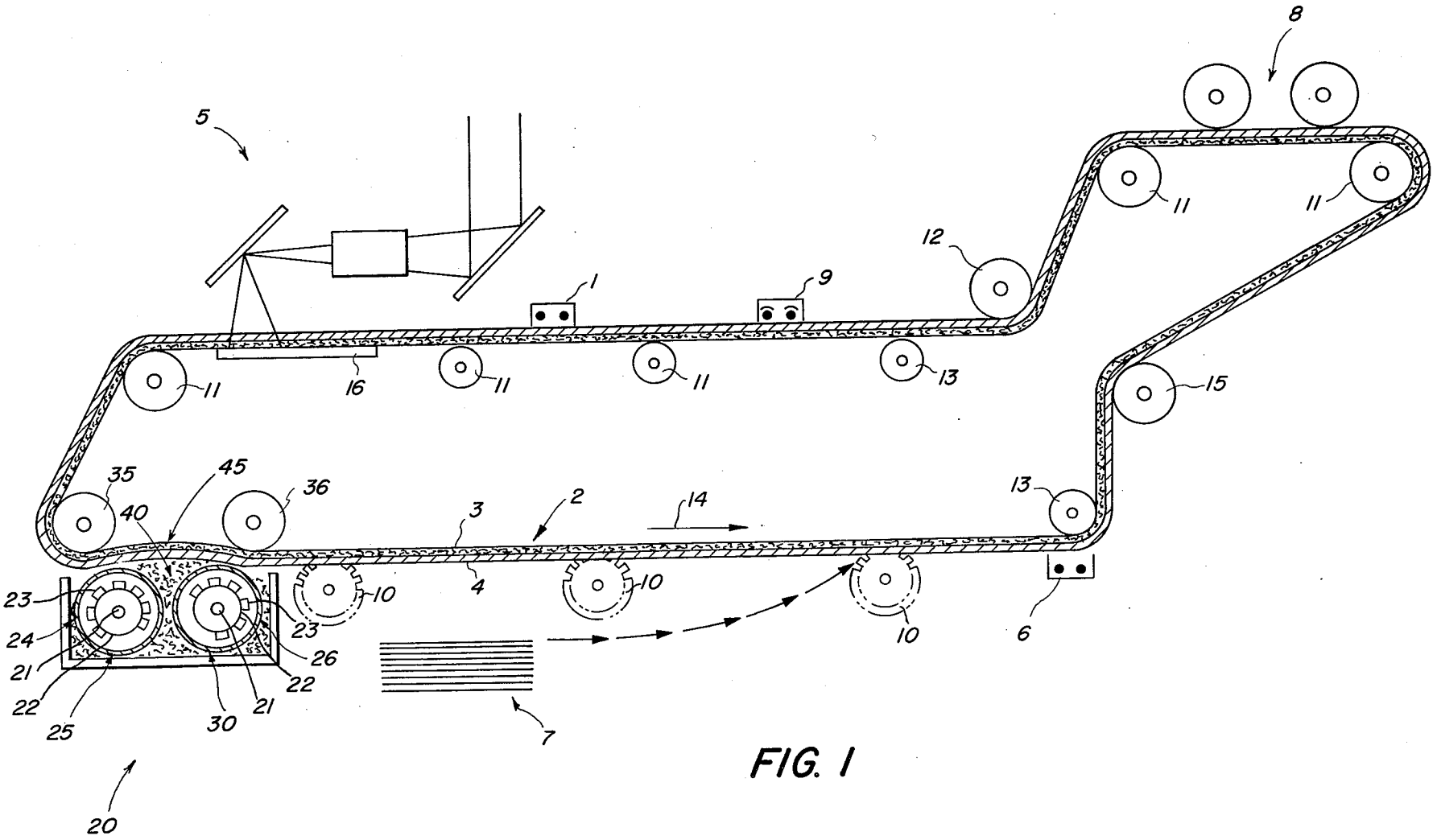
FIG. 1 is a schematic cross-sectional view of an electrographic apparatus incorporating one embodiment of the invention.

In accordance with the present invention photoconductor web 2 has perforations along its outer edges such that when engaged by sprocket drive rollers 10 web 2 is moved at a controlled rate in the direction of arrow 14. Sprocket drive rollers 10 are situated along the feed path of web 2 and are rotated in a manner such that as web 2 is moved along its feed path guided and supported by rollers 11, 13 and 15 a sufficient amount of slack is created in flexible web 2 such that web 2 can move in a non-tensioned condition along certain predetermined portions of its feed path. Film tension rollers 12 along with guide and support rollers 11, 13 and 15 operate to apply a sufficient amount of tension on web 2 to eliminate any undesirable slack which would otherwise be present at some of the operative stations along the web's feed path.

The development station 20 provided in the embodiment of the invention shown in FIG. 1 is of the type described in U.S Pat. No. 3,543,720 wherein brushes 25 and 30 can be constructed individually according to a variety of designs known in the prior art. A preferred design for this application includes a stationary core 21 of non-magnetic material around which is mounted a stationary magnetic pole piece 22 that may be made of soft steel or other magnetic material. Mounted around part of the circumference of pole piece 22 is a series of permanent magnets 23, for example, rubber-bonded barium ferrite magnetic strips or poles. Concentric with the arrangement of these elements and on the outside thereof are rotatable, preferably surface-roughened, non-magnetic cylinders 24 and 26. Each brush is constructed so that, as cylinders 24 and 26 rotate, developer particles are held on its surface and moved with the cylinder while in the field of the magnetic strips. The magnetic strips 23 are arranged so that a section of each cylinder is not in enough of the influence of the magnetic field to hold the developer on the cylinder. An accumulation of developer, created in cavity area 40 in a manner described in U.S. Pat. No. 3,543,720, is used to develop a latent electrostatic image being carried on layer 4 over development station 20.

In accordance with the present invention, the location of the development station relative to the continuous path of travel of the photoconductor and the spacing of guide rollers 35 and 36 are selected in a predetermined manner and those elements cooperate to allow the non-tensioned web segment passing therebetween to move in a direction generally normal to the continuous path of web travel in a controlled manner toward and away from the developer applicator and the accumulation of developer in cavity 40 as it advances over development station 20.

FIG. 2 illustrates a specific embodiment of the invention as described in FIG. 1 wherein the aforementioned parameters can be further understood. Brushes 25 and 30 are constructed in the manner described above with rotating cylinders 24 and 26 each having a three inch diameter and are separated by a distance of one-fourth inch at their closest outside points. The closest periphery of cylinder 24 is between 0.145 inch and 0.345 inch vertically below the line between the lower most peripheries of rollers 35 and 36 while the closest periphery of cylinder 26 is between 0.150 inch and 0.350 inch vertically below the same line. However, cylinders 24 and 26 are preferably 0.280 inch and 0.285 inch below the line between the lowermost peripheries of rollers 35 and 36, respectively.

Guide rollers 35 and 36, contacting belt 2 on its non-image-bearing side, are spaced apart by a distance which is between 1.38 and 2 times the sum of the radii of cylinders 24 and 26 and the distance between their closest outer peripheries such that the center point between rollers 35 and 36 is positioned along the same vertical axis as is the center point between brushes 25 and 30 which are located on the image-bearing side of belt 2. However the preferred distance between rollers 35 and 36 is 1.38 times the spacing from the center of cylinder 24 to the center of cylinder 26. By providing the spacing between rollers 35 and 36 within the desired range, web 2 is allowed to move vertically in an arc-like configuration such that midpoint 45 of web 2 is allowed to move at least 0.200 inch either toward or 0.200 inch away from the developer applicator and the accumulation of developer in cavity 40 where such movement of web 2 is relative to the lower peripheries of rollers 35 and 36 which contact web 2.

In a specific example using the FIG. 2 apparatus under the above-described conditions, layer 4 was moved over development station 20 at the rate of 10 inches per second. With the charge applied to photoconductor being varied between 300 and 500 volts in 50 volt increments and toner concentration being varied from 3 to 5 percent, images were uniformly developed in the image areas with very slight carrier pick-up by web 2.

The above-described apparatus is equally if not more advantageous in a multi-brush apparatus in which developer is not accumulated in cavity area 40 but is applied in a bristle formation. In such applicators, the magnets 23 are mounted closer together around the circumference of pole piece 22 such that almost every section of cylinders 24 and 26 is under enough of the influence of the magnetic field to attract and hold the developer to the rollers in a bristle-like formation. With this type apparatus the charge pattern on layer 4 is developed when it attracts the individual toner particles away from the carrier particles as brushes 25 and 30 brush across layer 4. In those instances where the bristle-like formations are not long enough to contact layer 4, area 45 will be able to move toward brushes 25 and 30 for a distance sufficient to allow brushes 25 and 30 to brush across layer 4. Area 45 will move away from brushes 25 and 30 when the brushes will otherwise make too rigid a contact with layer 4, resulting in some of the carrier particles either scratching layer 4 or being attracted by the charge pattern on layer 4.

Referring now to FIG. 3, which illustrates an alternative embodiment of the present invention, the subject invention makes use of a single magnetic brush applicator 50, having a non-magnetic cylinder 51, constructed in a manner similar to brushes 25 and 30 of FIG. 2. Guide rollers 11 and sprocket cylinders 5 all operate in a similar manner as described in FIG. 1 to move web 2 along its feed path. Guide rollers 35 and 36 are separated by a distance which is between 1.38 and 2 (preferably 1.38) times the radius of cylinder 51. The closest periphery of cylinder 51 is between 0.255 inch and 0.325 inch vertically below the line between the lowermost peripheries of rollers 35 and 36.

When the FIG. 3 apparatus is operated in a manner similar to that in which the FIG. 2 apparatus is operated, i.e., charge applied to brush 50 and variations in toner concentrations, images were uniformly developed in the image areas with slight carrier pick-up by web 2.

The present invention has been described using a double and a single magnetic brush developer applicator, however, it will be readily appreciated by one skilled in the art that the same principles and advantages would be applicable to magnetic brush applicators making use of any number of roller applicators, as well as to other roller applicators, e.g., of the fur brush type. The invention is generally designed to be useful in any development apparatus where continuous contact between the developer and the surface bearing the electrostatic charge pattern is desired.

The invention has been described in detail with particular reference to certain embodiments thereof, but it will be understood that variations and modifications can be effected within the spirit and scope of the invention.

We claim:

1. In electrographic apparatus of the type including a flexible web having an imaging side, a developer applicator, including at least one generally cylindrical member, and drive and guide means for controlling movement of said web around an endless path past said applicator, the improvement wherein:

said drive and guide means are constructed and located along said endless path in a manner such that said web is in a non-tensioned condition during its passage over said applicator; and a portion of said guide means includes rotatable guide rollers spaced apart, in a direction generally parallel to said path, a distance which is between about 1.38 and 2 times the sum of the radii of said developer applicator members plus any spacing between said applicator members and located with respect to said developer applicator so that the center point between said rollers is located substantially directly opposite, across said endless path, the center of said applicator.

2. Apparatus as recited in claim 1 wherein said developer applicator is spaced below said guide rollers a distance which is between 0.255 inch and 0.325 inch vertically below the line between the lowermost peripheries of said guide means, proximate said applicator.

3. An electrographic apparatus, comprising:

a. a flexible photoconductor web mounted in said apparatus for movement along an endless path;

b. a magnetic brush developer applicator, including at least a first applicator and a second applicator, located to apply toner to one side of said flexible web as said web is moved along an endless path therepast, said first applicator being located to apply toner to said web before said second applicator;

c. drive and guide means constructed and located along said endless path in a manner such that said web is in a non-tensioned condition during its passage over said first and second applicators; and d. first and second control rollers located on the opposite side of said web from said first and second applicators, said first and second rollers separated by a distance which is between 1.38 and 2 times the distance from the center of said first applicator to the center of said second applicator and being substantially equidistant from the center point on a line between the axes of said first and second applicators.

4. The invention defined in claim 3 wherein said first applicator is vertically displaced below said flexible photoconductor web by a distance which is between 0.145 inch and 0.345 inch vertically below the line between the lowermost peripheries of said control rollers and said second applicator is vertically displaced below said flexible web by a distance which is between 0.150 inch and 0.350 inch vertically below said line between the lowermost peripheries of said control rollers so that said flexible web can be vertically displaced toward and away from said first and second applicators by a distance which is sufficient to allow any electrostatic image carried by said web to be uniformly developed.

5. In electrographic apparatus of the type including a flexible electrographic web, means for moving said web around an endless operative path and brush means, located along said path, for applying toner to electrostatic images on said web during its movement therepast, the improvement comprising:

a. means for controlling and supporting movement of said web along said path so that successive web sections, while passing said applicator, are in a slackened condition; and b. a pair of web guide members located along said path on the opposite side of said web from, and generally equidistant to, said brush, said guide members being spaced apart a distance greater that the extension of said brush means in the direction of web movement whereby said slackened sections of said web can move toward and away from said brush means a distance sufficient to compensate for variations in the quantity of toner on said brush means and provide uniform development.

6. In electrographic apparatus of the type including a flexible electrographic web, means for moving said web around an endless operative path and brush means, located along said path, for applying toner to electrostatic images on said web during its movement therepast, the improvement comprising:

a. means for controlling and supporting movement of said web along said path so that successive web sections, while passing said applicator, are in a slackened condition; and b. guide means, located along said path on the opposite side of said web from said brush means, for maintaining said web in contact with said brush means and allowing substantial floating movement, in the directions generally normal to said path, of the slackened web sections passing over said brush means.

7. The invention defined in claim 6 wherein said guide means comprises a pair of rollers spaced generally equidistantly from said brush means and spaced apart a distance greater than the extension of said brush means in the direction of web movement.

8. The invention defined in claim 7 wherein brush means comprises a pair of spaced toner applicator cylinders and said guide rollers are spaced apart in the range of about 1.38 to 2.00 times the sum of the radii of, plus the distance between, said applicator cylinders.

* * * * *